United States Patent [19]

Carter

[11] 4,247,243

[45] Jan. 27, 1981

[54] SAFETY CATCH FOR A MOVABLE BUCKET FORK LIFT ATTACHMENT

[76] Inventor: Jack D. Carter, 609 Curdes Ave., Fort Wayne, Ind. 46805

[21] Appl. No.: 13,135

[22] Filed: Feb. 21, 1979

[51] Int. Cl.[3] ..... B66F 9/00

[52] U.S. Cl. ..... 414/724; 187/9 R

[58] Field of Search ..... 187/9 R, 9 E; 414/697, 414/724, 723, 685, 629, 631, 641, 642, 639; 172/272; 37/117.5, DIG. 3

[56] References Cited

U.S. PATENT DOCUMENTS

| | | | |
|---|---|---|---|
| 2,473,505 | 6/1949 | Brock | 414/724 |
| 3,795,331 | 3/1974 | Guest | 414/697 |
| 4,125,952 | 11/1978 | Jennings | 414/724 |

*Primary Examiner*—Robert J. Spar
*Assistant Examiner*—Kenneth Noland
*Attorney, Agent, or Firm*—Gust, Irish, Jeffers & Rickert

[57] ABSTRACT

A conventional earth moving bucket is provided with hooks including elongated notches with openings intermediate the ends thereof with those hooks being positioned along a bucket upper edge to receive a fork lift attachment. The attachment has a horizontal support which fits in the hook notches and L shaped fork lift elements are pivotably mounted at their top on the horizontal support with the lower part of the fork lift elements resting against the lower part of the bucket. A latch member is mounted on a fork lift element for coupling that element to the bucket to prevent relative pivotal movement of the fork lift element about the horizontal support relative to the bucket only when the bucket is in certain specified attitudes. The latch member may comprise one or more tines in cooperation with the bucket lower edge or may comprise a locking strip fastened to the bucket in conjunction with a generally L shaped hook fastened to the fork lift elements. In either case, movement of the bucket to an unusual attitude which might otherwise cause the fork lift attachment to pivot and become disengaged from the hooks first causes the attachment to slide relative to the bucket engaging the latch and preventing the attachment from becoming disengaged from the bucket.

2 Claims, 14 Drawing Figures

SAFETY CATCH FOR A MOVABLE BUCKET FORK LIFT ATTACHMENT

BACKGROUND OF THE INVENTION

1. Field of the Invention

The present invention relates generally to attachments for power earth moving machines and more particularly to a safety catch arrangement for such attachments.

2. Description of the Prior Art

Typical power earth moving machines employ a movable arm of one or more links or members pivotably interconnected and having hydraulic or other actuating devices for operating a tool such as an earth moving bucket or blade supported on that arm. Numerous attachments for the earth moving machine tool have been devised including the fork lift attachment disclosed in my prior U.S. Pat. No. 3,421,642.

In my prior patented arrangement, a fork lift attachment can be easily mounted on and removed from a conventional loader bucket by rotating that bucket in one sense and hookingly engaging the attachment whereupon the bucket is rotated in the opposite sense until the fork lift attachment engages the bucket lower edge thereby locking the attachment to the bucket for subsequent use. This arrangement has met with considerable commercial success due at least in part to the ease with which the attachment may be picked up, used and later removed, freeing the machine for other work. The locking of the attachment to the bucket is not, however, a complete locking but rather the attachment and bucket are coupled firmly only in normal bucket and attachment operating attitudes. Gravitational or inertial forces on the attachment as might be experienced by wildly swinging the arm of the earth moving machine or as might occur when the earth moving machine tool is moved to a position or orientation not suited to normal fork lift operation could allow the attachment to become disengaged from the bucket causing equipment damage or injury to an operator or bystander.

SUMMARY OF THE INVENTION

Among the several objects of the present invention may be noted the provision of an earth moving machine attachment having a safety catch for reducing the likelihood of injury to man or machine; the provision of a fork lift attachment for a power earth moving machine which attachment is locked to the machine in a secure yet easily disengagable manner; the provision of a safety catch for a movable bucket fork lift attachment, the provision of a latch member mounted on a fork lift element for coupling that element to a power earth moving machine bucket to prevent relative rotational movement between the fork lift element and the bucket only when the bucket is in certain specified attitudes; and the provision of a safety catch for a fork lift attachment which does not interfere with normal fork lift operation nor with the normal process of engaging or disengaging the fork lift attachment but which, however, reduces the likelihood of inadvertent disengagement of the fork lift attachment.

These as well as other objects and advantageous features of the present invention will be in part apparent and in part pointed out hereinafter.

In general and in one form of the invention a fork lift attachment for a power earth moving machine has two or more fork lift members pivotably attachable to the movable arm of the earth moving machine in such manner that a limited amount of linear movement between the members and the arm is allowed. Pivotal movement of the members relative to the arm is limited when the members are near one of the relative linear movement extremes by, for example, the lower edge of a movable bucket on the power earth moving machine arm. Pivotal movement of the fork lift members in the opposite sense is not normally prevented; however, when the members are near the other of their relative linear movement extremes, such opposite sense pivotal movement is also prevented so that the fork lift members are not easily inadvertently dislodged. The mechanism which prevents this relative rotation in the opposite sense comprises a latch arrangement between the fork lift members and the bucket and when the fork lift members are in their normal operating attitude, the latching arrangement is ineffective. However, when the fork lift members are raised high in the air and tilted substantially from their normal operating positions the members slide relative to the movable arm and bucket or other tool so as to engage the latch and prevent the members from rotating and becoming dislodged.

BRIEF DESCRIPTION OF THE DRAWING

Corresponding reference characters indicate corresponding parts throughout the several views of the drawing.

Figure 1:
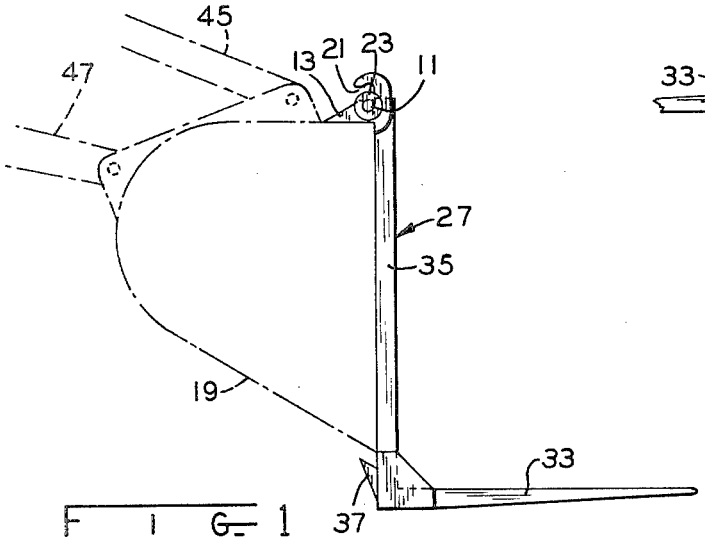
FIG. 1 is a side elevation view of a power earth moving machine arm and bucket with the fork lift attachment mounted thereon in normal operating attitude.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

In general the attachment according to the present invention has an elongated horizontal support 11 which is adapted to fit over a plurality of spaced retaining hooks 13, 15, 17 and 19. These retaining hooks are fastened, for example by welding, to the upper portion of a movable bucket 19 with each retaining hook having a notch 21 that opens toward the rear of the bucket. It will be noted that, as viewed in FIG. 1, the notch opening 21 is intermediate the ends of the elongated notch with the horizontal support 11 resting in the lower portion of that elongated notch. In conventional pushing, moving or hauling uses of the bucket, the hooks 13, 15, 17 and 19 do not interfere with bucket operation yet, when it is desired to use the bucket for fork lift purposes, the fork lift attachment may be rather easily attached to the bucket by means of these hooks.

The elongated support 11 has a length greater than the distance between the outer hooks 13 and 19 and has a cross-sectional configuration which is adapted to be easily picked up but securely held by the retaining hooks. The ends of the horizontal support 11 are positioned outwardly of the retaining hooks and have projections 23 and 25 which prevent the horizontal support from sliding off the hooks.

A plurality of fork lift elements such as 27 and 29 are pivotally mounted on the support 11 between its ends with each fork lift element comprising a rigid generally L shaped member formed of a vertical upper portion and a horizontal lower portion. The upper end of each vertical portion is pivotally and slidingly mounted on the horizontal support 11 and the lower part of each vertical portion is dimensioned and adapted to rest against the lower forward face 31 of the bucket. The horizontal portion of each fork lift element extends forwardly from the bucket (toward the right in FIG. 1) so that each horizontal portion is available for pallet lifting.

In FIG. 1 the fork lift element horizontal portion 33 extends toward the right from the lower extreme of the fork lift element vertical portion 35 and also near the lower extreme of the vertical portion 35 is located a tine 37 which extends therefrom in a direction opposite the horizontal portion 33. Tine 37 is spaced below the forward face bucket lower edge 31 so as to not engage that lower edge 31 when the horizontal support 11 is at one extreme of the elongated notch in hook 13. If for some reason the fork lift attachment were urged upwardly as viewed in FIG. 1 so that horizontal support 11 occupied the upper portion of the elongated notch in hook 13, tine 37 would engage the lower front edge 31 of bucket 19. Typically the distance by which the tine 37 is spaced from the bucket lower edge 31 is substantially the same as the difference between the length and width of the elongated notch in hook 13.

Figure 4:
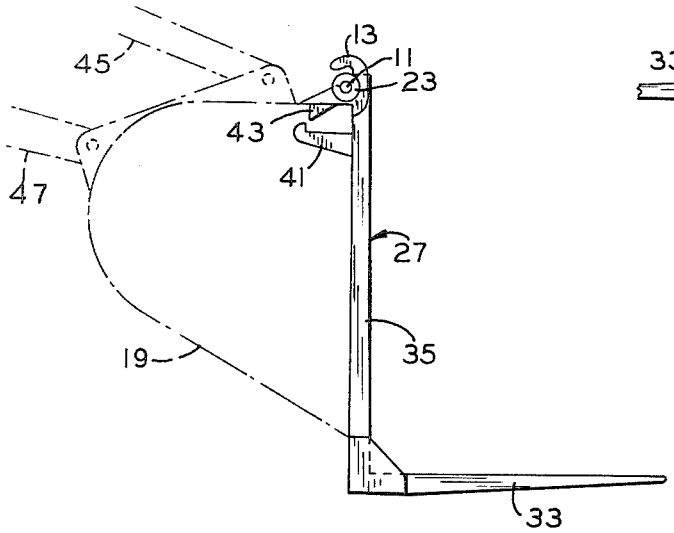
FIG. 4 is a side elevation view similar to FIG. 1 but illustrating a modified latch arrangement coupling the bucket and fork lift elements.
Figure 5:
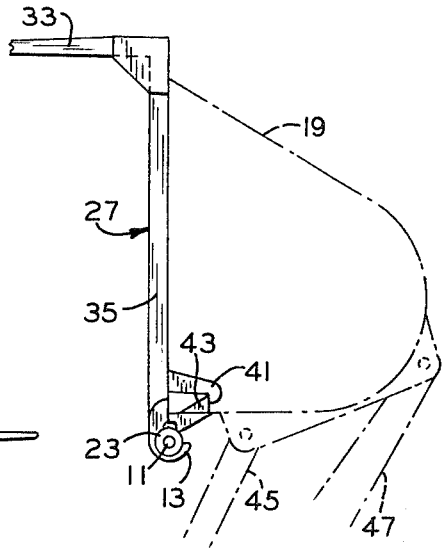
FIG. 5 is a view similar to FIG. 3 but illustrating the latch arrangement of FIG. 4.

Tine 37 and typically a similar tine 39 on the other fork lift member or element function as a latch member for coupling the fork lift elements to the bucket only in certain specified bucket and fork lift attachment attitudes and this same latching function may be achieved by latch members such as the generally L shaped hook 41 in FIGS. 4 and 5.

In FIG. 4 the bucket includes a locking strip 43 near the upper edge of the forward face of the bucket which could, of course, comprise a strip of metal welded to that interior upper edge. Latch member 41 is normally aligned with and spaced from the locking strip 43 as illustrated in FIG. 4. Sliding movement of the attachment 27 relative to the bucket 19 allows the L shaped hook 41 to engage the locking strip 43 as illustrated in FIG. 5 with this engagement preventing relative pivotal movement between the attachment 27 and the bucket 19. Movement between the engaged and disengaged positions of hook 41 and locking strip 43 as well as the movement between the tine 37 and the lower front edge 31 of the bucket 19 in the respective illustrated embodiments correspond to the extremes of movement of the horizontal support rod 11 within the elongated notch of hooks such as 13.

Figure 3:
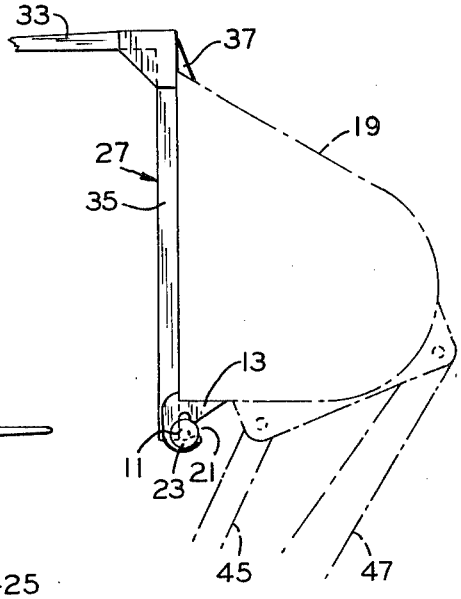
FIG. 3 is a view similar to FIG. 1 but illustrating the bucket and attachment raised quite high and rotated out of its normal operating attitude.
Figure 2:
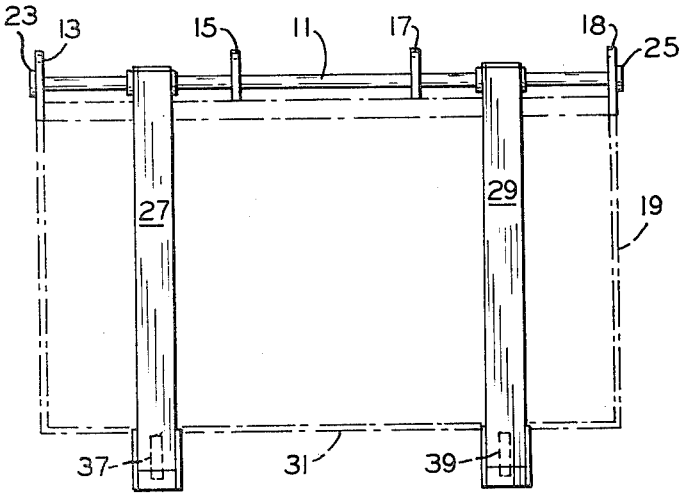
FIG. 2 shows a front view of the bucket of FIG. 1 with the fork lift members mounted thereon.

The L shaped hook 41 may, of course, be repeated for each fork lift element 27 and 29 or those two fork lift elements may be tied together as is desired, but in any event the L shaped hook 41 functions substantially the same as the tine 37 in that in the positions illustrated in FIGS. 1 and 4 which are normal fork lift operating attitudes, the latching arrangement does not prevent couterclockwise movement of the fork lift elements such as 27 relative to the bucket 19. However, in abnormal bucket and attachment attitudes such as illustrated in FIGS. 3 and 5, tine 37 engages the bucket lower (now upper) edge 31 to prevent counterclockwise rotation of the fork lift element 27 relative to the bucket 19 and analogously L shaped hook 41 engages strip 43 as illustrated in FIG. 5, again preventing the counterclockwise rotation of the fork lift element 27. Even though a bucket with its connecting arm including linkages such as 45 and 47 may not be able to attain the extreme counterclockwise high position illustrated in FIGS. 3 and 5, the same effect may occur due to inertial forces when the bucket is raised and stopped abruptly and so long as the attachment slide relative to the bucket into the latch coupled positions of FIGS. 3 and 5, rotation will be prevented.

Figure 6A:
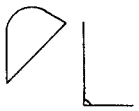
FIGS. 6*a* through 6*i* schematically illustrate a sequence of attachment positions with and without the safety feature of the present invention.
Figure 6B:
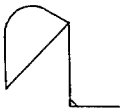
Figure 6C:
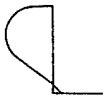
Figure 6D:
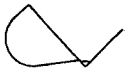
Figure 6E:
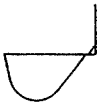
Figure 6H:
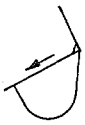
Figure 6I:
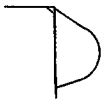
Figure 6F:
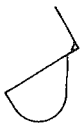
Figure 6G:
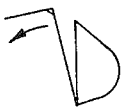

With a removed attachment resting on the gournd on its horizontal portions, the bucket 19 with the hooks such as 13 may be maneuvered into position so that the hooks are brough under and forward of the horizontal support 11. The bucket is then lifted in such a manner that the horizontal support passes through the intermediate opening 21 and rests within the elongated notches of the hook with this initial engaging being illustrated in FIGS. **6*a* and 6*b*. The bucket is then rotated so that the lower part of the vertical portions 35 come to rest against the forward lower face 31 as illustrated in FIG. 6*c*. This is the normal operating attitude of the bucket as also illustrated in FIGS. 1 and 4. It the bucket and attachment are now rotated in a counterclockwise direction as sequentially illustrated in FIGS. 6*c*, 6*d*, 6*e* and 6*h*, the elongated slot allows the attachment to slide relative to the bucket as illustrated by the arrow in FIG. 6*h* and thereafter continued counterclockwise rotation to, for example, the position illustrated in FIG. 6*i*, may occur without the attachment pivoting on support rod 11 since the latching arrangement locks due to the sliding movement of FIG. 6*h*. Without the latch of the present invention continued counterclockwise rotation of the bucket and attachment as illustrated in FIGS. 6*d*, 6*e*, 6*f* and 6*g* will allow the attachment to pivot about its supporting rod 11 causing potential damage to equipment or persons. With the bucket and attachment in the position illustrated in FIG. 6*g*, the attachment may rotate and in addition may become unlatched from the hooks 13, 15, 17 and 19 whereas with the latching arrangement of the present invention the attachment remains in position as illustrated in FIG. 6I which corresponds to FIGS. 3 and 5** for the respective latching arrangement.

From the foregoing it is now apparent that a novel safety catch in two forms has been disclosed meeting the objects and advantageous features set out hereinbefore as well as others and that modifications as to the precise configurations, shapes and details may be made. For example, the support rod 11 may be made of an other than circular cross-section configuration with the elongated notch allowing pivotal movement of the attachment so long as the support rod 11 occupies the lower portion of the notch as illustrated in FIGS. 1 and 4; however, the notch upper portion may be configured to mate with the noncircular cross-section of support 11 in a manner to prevent relative rotation when that support rod 11 occupies the upper part of the notch as illustrated in FIGS. 3 and 5. This as well as numerous modifications may be made by those having ordinary skill in the art without departing from the spirit of the invention or the scope thereof as set out by the claims which follow.

What is claimed is:

1. An attachment for use with a movable bucket or the like having a plurality of substantially similar spaced retaining hooks, each of said hooks including an elongated notch having an opening intermediate the ends thereof, and each of said hooks being fastenable to an upper portion of a movable bucket along a substantially horizontal line with the hook notch opening aligned, the attachment comprising:

(a) an elongated horizontal support having a length greater than the distance between the outer ones of said spaced retaining hooks, said horizontal support having a cross-sectional configuration adapted to be easily picked up but securely held in said notches of said retaining hooks with the ends of said horizontal support positioned outwardly of said outer spaced retaining hooks respectively;

(b) first and second fork lift elements mounted on said horizontal support, each of said fork lift elements having a rigid, generally L-shaped configuration formed by a vertical portion and a horizontal portion, the upper end of said vertical portion being mounted on said horizontal support with the lower part of said vertical portion adapted to rest against the forward face of said bucket and with the horizontal portion extending forwardly from said bucket with the end of said horizontal portion spaced from said bucket; and (c) a latch member mounted on a fork lift element for coupling the fork lift element to the bucket to prevent relative pivotal movement of the fork lift element about the horizontal support relative to the bucket only when the bucket is in certain specified attitudes, the bucket including a locking strip near the upper edge of the forward face, the latch member comprising at least one generally L-shaped hook normally aligned with and spaced from the locking strip, sliding movement of the attachment relative to the bucket engaging the L-shaped hook with the locking strip to prevent relative pivotal movement.

2. The attachment of claim 1 wherein the attachment is movable linearly relative to the bucket and within limits imposed by the elongated notch between latch coupled and latch uncoupled positions.

* * * * *